US005197155A

United States Patent [19]

Ogle et al.

[11] Patent Number: 5,197,155

[45] Date of Patent: * Mar. 30, 1993

[54] FOUNDATION UNIT WITH SNAP-FIT MODULAR SPRINGS

[75] Inventors: Steven E. Ogle; Danny L. Wylie, both of Carthage, Mo.

[73] Assignee: L&P Property Management Company, Chicago, Ill.

[ * ] Notice: The portion of the term of this patent subsequent to Sep. 1, 2009 has been disclaimed.

[21] Appl. No.: 827,006

[22] Filed: Jan. 28, 1992

Related U.S. Application Data

[63] Continuation-in-part of Ser. No. 786,021, Oct. 31, 1991, Pat. No. 5,142,716.

[51] Int. Cl.[5] ..... A47C 23/04; A47C 23/053

[52] U.S. Cl. ..... 5/247; 5/255; 267/103

[58] Field of Search ..... 5/247, 255, 476, 263, 5/260, 267; 267/103

[56] References Cited

U.S. PATENT DOCUMENTS

| | | | |
|---|---|---|---|
| 3,833,948 | 9/1974 | Surletta, et al. | 5/247 |
| 4,000,531 | 1/1977 | Imman | 5/267 |
| 4,068,329 | 1/1978 | Gross et al. | 5/255 |
| 4,760,616 | 8/1988 | Hiatt et al. | 5/255 |
| 4,828,233 | 5/1989 | Hagemeister | 5/248 |
| 4,838,528 | 6/1989 | Hagemeister | 5/255 |
| 4,862,532 | 9/1989 | Wells et al. | 5/247 |
| 4,867,424 | 9/1989 | Dabney | 267/103 |
| 4,896,386 | 1/1990 | Ogle et al. | 5/247 |
| 4,903,949 | 2/1990 | Schulz, Jr. | 267/103 |
| 4,995,125 | 2/1991 | Dennison | 5/247 |
| 5,005,809 | 4/1991 | Harmon | 5/247 |

*Primary Examiner*—Alexander Grosz
*Attorney, Agent, or Firm*—Wood, Herron & Evans

[57] ABSTRACT

A bedding foundation unit having a top planar portion defined by two pluralities of spaced parallel grid wires, and a rigid frame spaced apart from the top planar portion by a plurality of modular springs. Each modular spring is formed from one piece of wire and has a top section, two vertical legs and two foot sections, with each of the vertical legs having at least one arcuate portion. The top section of most, if not all, of the modular springs extend longitudinally of the foundation and are connected to the top planar portion in a snap-fit manner, each top section of each modular spring being held in place by three grid wires and one grid wire below the top section.

31 Claims, 5 Drawing Sheets

FOUNDATION UNIT WITH SNAP-FIT MODULAR SPRINGS

RELATED APPLICATION

This application is a continuation-in-part application of U.S. Pat. application Ser. No. 07/786,021 filed Oct. 31, 1991, now U.S. Pat. No. 5,142,715.

FIELD OF THE INVENTION

This invention relates to bedding foundation units and, more particularly, to bedding foundation units with modular springs having snap-fit connections.

BACKGROUND OF THE INVENTION

Bedding foundation units are well known. Typical foundation units include a rigid base frame and a top planar portion supported above the frame by numerous coil springs. The top planar portion is typically defined by a welded wire grid. The spring elements are typically stapled to the wooden frame below and clipped or welded to the wire grid above. Typically a pad is placed over the top planar portion and the entire assembly is surrounded with a cover.

Foundation units which use modular springs rather than coil springs to support the top planar portions from the frame are also known. For example, a modular spring and a foundation unit based on that modular spring are shown in U.S. Pat. No. 3,833,948, assigned to the assignee of the present invention, the disclosure of which is fully incorporated herein by reference. However, these modular springs are typically connected to the upper wire grid by clips, crimps, welding, or other means requiring special equipment and substantial labor. Consequently, the foundation unit cannot be manufactured as economically as desired.

Thus, it is desirable to be able to attach the modular springs to the planar top portion without requiring clips, crimps or welds etc. Several techniques for attaching the modular springs to the planar top portion without the use of clips, crimps or welds are shown, for example, in U.S. Pat. Nos. 4,828,233, 4,838,528, and 5,005,809. However, these patented techniques either require a series of complex bends to be made in the welded wire grid or in the modular spring elements or require numerous grid wires and/or modules to make a satisfactory foundation.

Modular springs used in foundation units have various geometric configurations. One typical modular spring configuration used in foundation units is shown in U.S. Pat. No. 4,000,531.

SUMMARY OF THE INVENTION

An objective of the present invention is to provide an economical bedding foundation in which only modular springs are used and most, if not all, of the modular springs are secured to the grid wires of the top planar portion of foundation units, without the use of clips, welds or other means requiring special equipment and substantial labor.

Another objective of the present invention is to provide a modular spring which provides appropriate resilience with a minimum of modular spring wire and which may be attached to the frame with a minimum of staples and/or expense.

An additional objective of the present invention is to provide a modular spring which has many of the performance characteristics of a coil spring (i.e., is very resilient) but the economic benefits of modular springs.

The present invention achieves these objectives by providing a simplified snap-fit connection between the modular springs and the grid wires of the top planar portion and by utilizing improved modular springs.

In accordance with the principles of the present invention, the number of, the placement of, and the design of the grid wires of the top planar portion of a bedding foundation are so constructed as to enable a snap-fit connection to be made between the top section of most, if not all, of the improved modular springs in the foundation unit and the grid wires.

In accordance with the practice of this invention, the top section of each modular spring is planar and is so constructed as to enable a snap-fit connection to be made between the grid and the springs. Each spring has two vertical legs which extend down from the planar top section and a foot section which extends out from each vertical leg. This planar top or snap-fit section may be visualized as four bends in a piece of straight wire that form five coplanar segments: a centermost longitudinal section, two longitudinal end sections, each being parallel to but offset from the centermost longitudinal section, and being connected thereto with a transverse straight portion. The vertical legs each have at least one arcuate lower portion having an arc of at least about 180° and a vertical straight upper portion which connects the arcuate lower portion to one of the longitudinal end sections of the snap-fit section. Each of the two foot sections preferably are generally L-shaped with their free ends welded or otherwise connected together.

The planar top portion of the foundation is defined by two pluralities of spaced parallel grid wires, each plurality lying perpendicular to the other. The snap-fit section of the modular spring can be connected to four grid wires of the planar top portion as follows: One grid wire from the second plurality of spaced parallel grid wires extends over both transverse straight portions of the modular spring. A second grid wire from the second plurality extends under both transverse straight portions. Finally, a pair of grid wires from the first plurality of spaced parallel grid wires extends over the longitudinal end sections in such a manner that one grid wire extends over each longitudinal end section. Thus, when the snap-fit connection is used, the snap-fit section of the modular spring is held in place by one grid wire extending under and three grid wires extending over the various segments of the snap-fit sections.

The advantage of a bedding foundation formed in this manner and having modular springs of this construction is that it provides a very economical foundation which may be easily and economically assembled without the use of any special tools. It also has the advantage of having many of the resilience characteristics of a coil spring foundation but without the expense normally associated with such foundations.

These and other objectives and advantages of the present invention shall become more readily apparent from the following detailed description taken in conjunction with the drawings herein, in which:

DETAILED DESCRIPTION OF THE PREFERRED EMBODIMENTS

Figure 1:
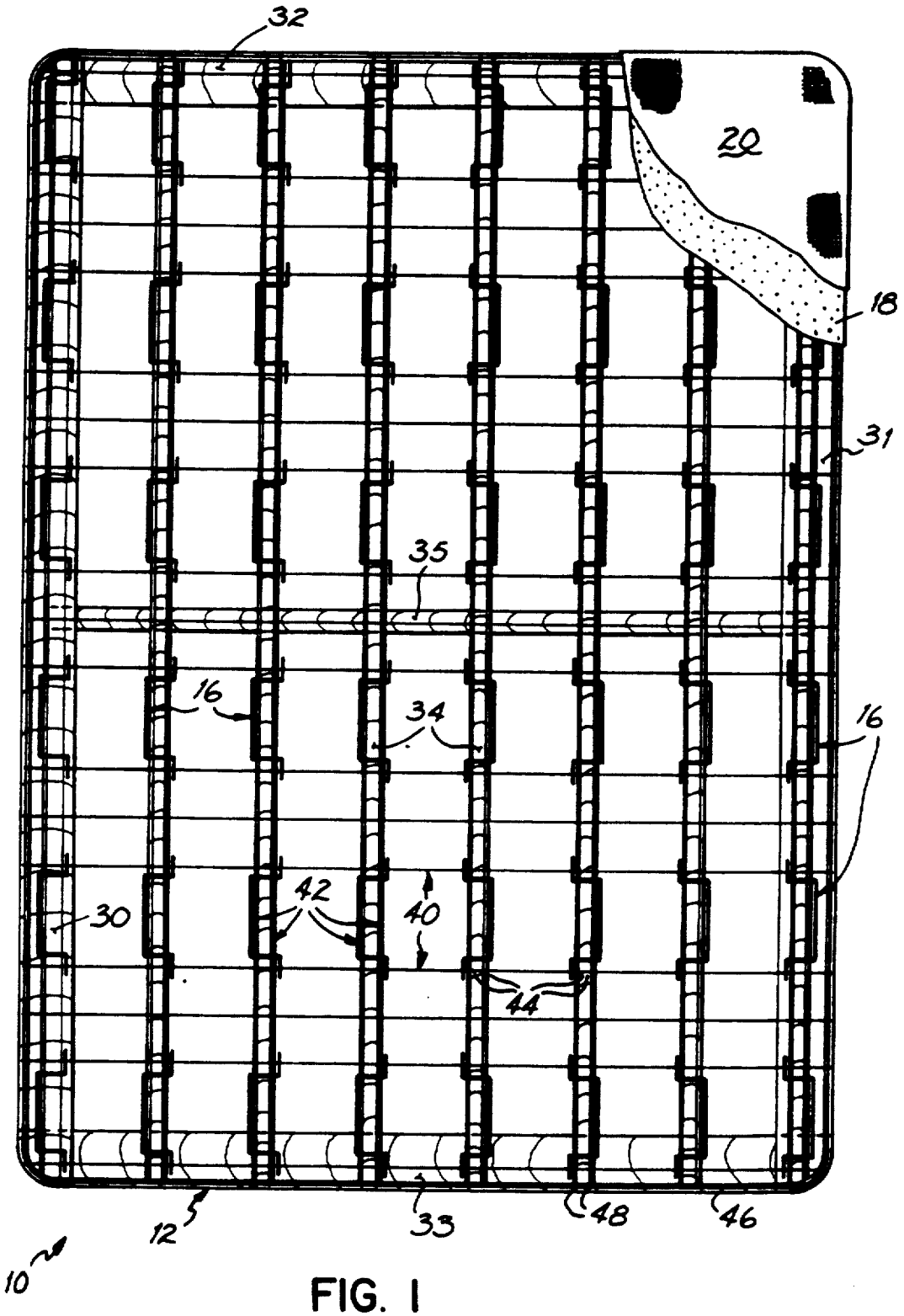
FIG. 1 is a top plan view, mostly broken away, of a foundation unit incorporating the present invention.

With reference first to FIGS. 1-5, there is illustrated a foundation unit 10 employing one embodiment of the present invention. This foundation unit comprises a frame 12, a planar top portion 14, and a plurality of modular springs 16. A pad 18 rests on the top surface of the planar top portion 14. An upholstered covering 20 encases the frame 12, the planar top portion 14, the plurality of modular springs 16, and the pad 18.

The frame 12 comprises two laterally spaced longitudinal frame members 30 and 31, two longitudinally spaced lateral frame members 32 and 33, and a plurality of longitudinally extending slats 34 and a cross-slat 35. These members 30, 31, 32 and 33 and slats 34 and 35 are all secured by nails or other suitable means to provide a rigid frame 12 for the foundation unit, such that slats 34 are generally parallel to longitudinal frame members 30 and 31 and generally perpendicular to lateral frame members 32 and 33, and cross-slat 35 is generally parallel to lateral frame members 32 and 33 and perpendicular to longitudinal frame members 30 and 31.

The planar top portion 14 is defined by a first plurality of spaced parallel grid wires 40 and a second plurality of spaced parallel grid wires 42 lying perpendicular to and connected to the first plurality of grid wires 40. Individual grid wires 40 and 42 are interconnected by welds or other suitable means at the points at which they cross 44.

Figure 2:
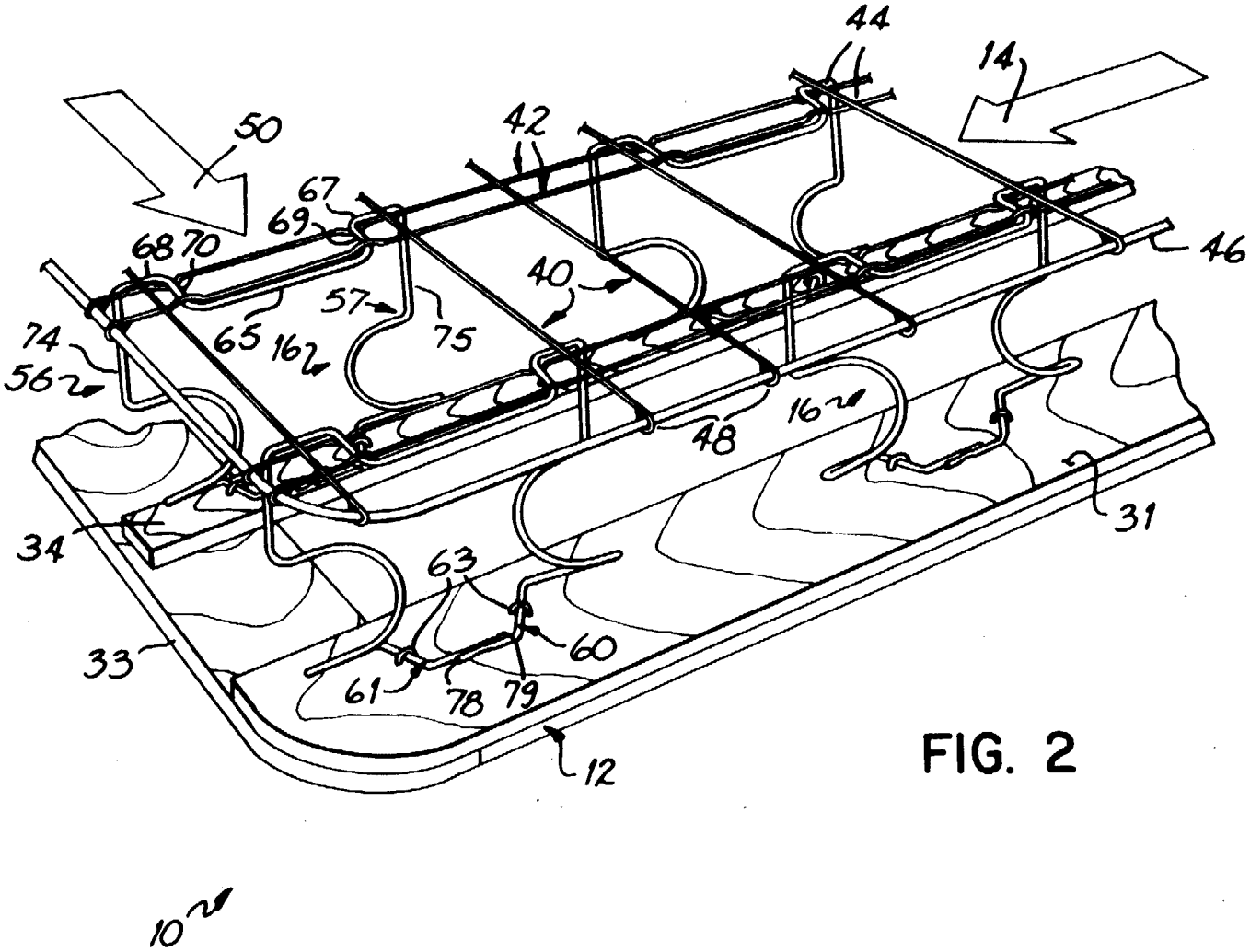
FIG. 2 is a perspective view of a corner portion of the bedding foundation unit of FIG. 1.

Referring to FIG. 2, it will be seen that the boundary of the planar top portion 14 is defined by border wire 46. Grid wires 40 and 42 are connected to border wire 46 at 48 by welding or by wrapping (as shown in FIG. 2), or in the preferred embodiment by both wrapping and welding.

In the first embodiment of the invention illustrated in FIGS. 1-5, only modular springs 16 which extend longitudinally are used and only in a single spring attachment configuration in the foundation unit (see FIG. 1). The frame 12 and the planar top portion 14 are spaced apart by a plurality of modular springs 16. The modular springs 16 are attached or connected to the planar top portion 14 and connected to and interspaced along the length of said longitudinal frame members 30 and 31 and slats 34. Each modular spring 16 comprises a planar top section 50 at its upper end, two vertical legs 56 and 57 at its middle and two foot sections 61 and 60 at its base. Modular springs 16 are attached at foot sections 60 and 61 to the top surface of longitudinal frame members 30 and 31 and slats 34 by means of staples 63 or by other suitable means. The planar top sections 50 at the upper ends of modular springs 16 are snap-fitted into the two pluralities of spaced parallel grid wires 40 and 42, which define the planar top portion 14. This snap-fit connection will be described in greater detail below.

Figure 3:
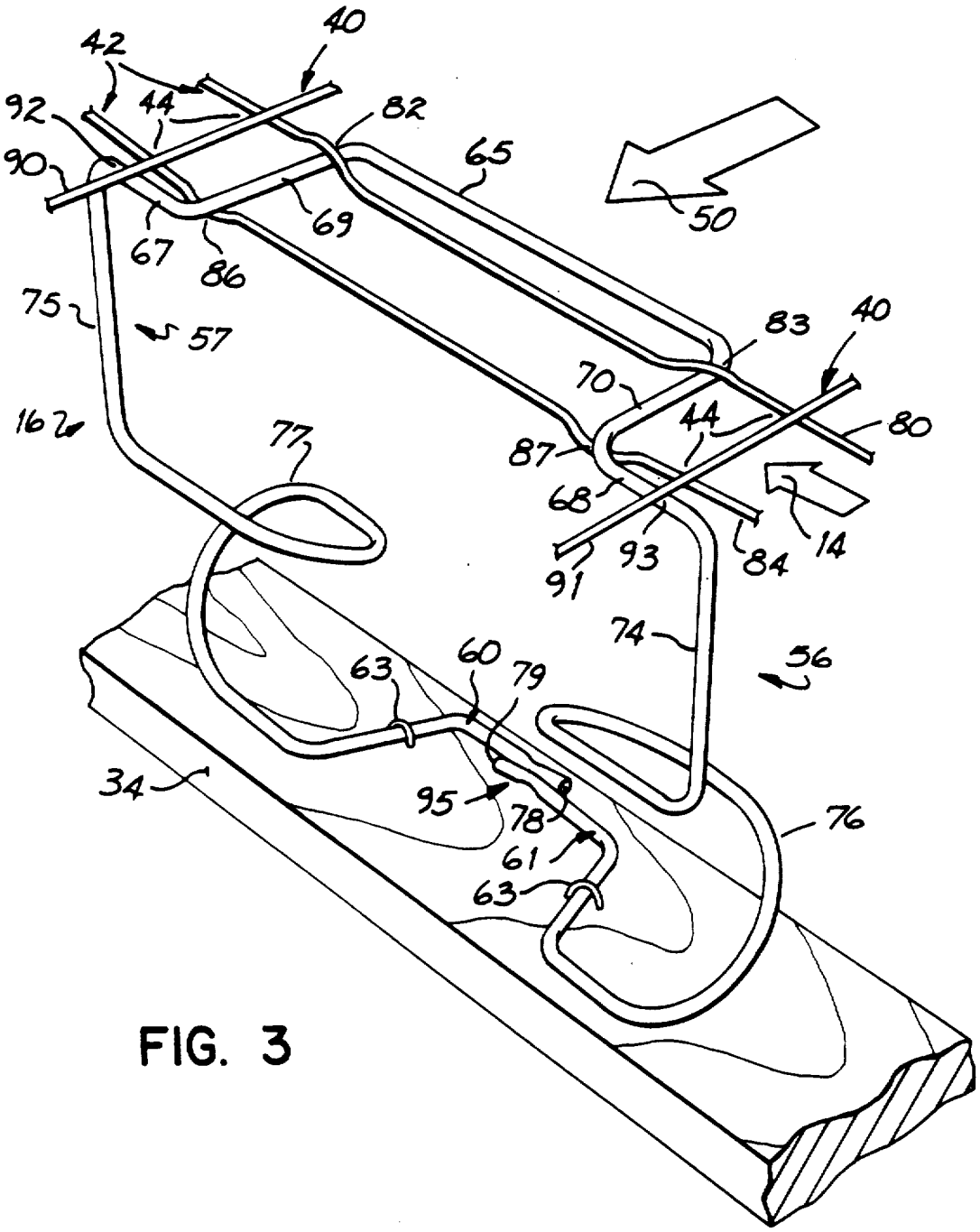
FIG. 3 is a perspective view of one embodiment of a modular spring in snap-fit connection with part of the planar top portion of a foundation unit according to the present invention.
Figure 4:
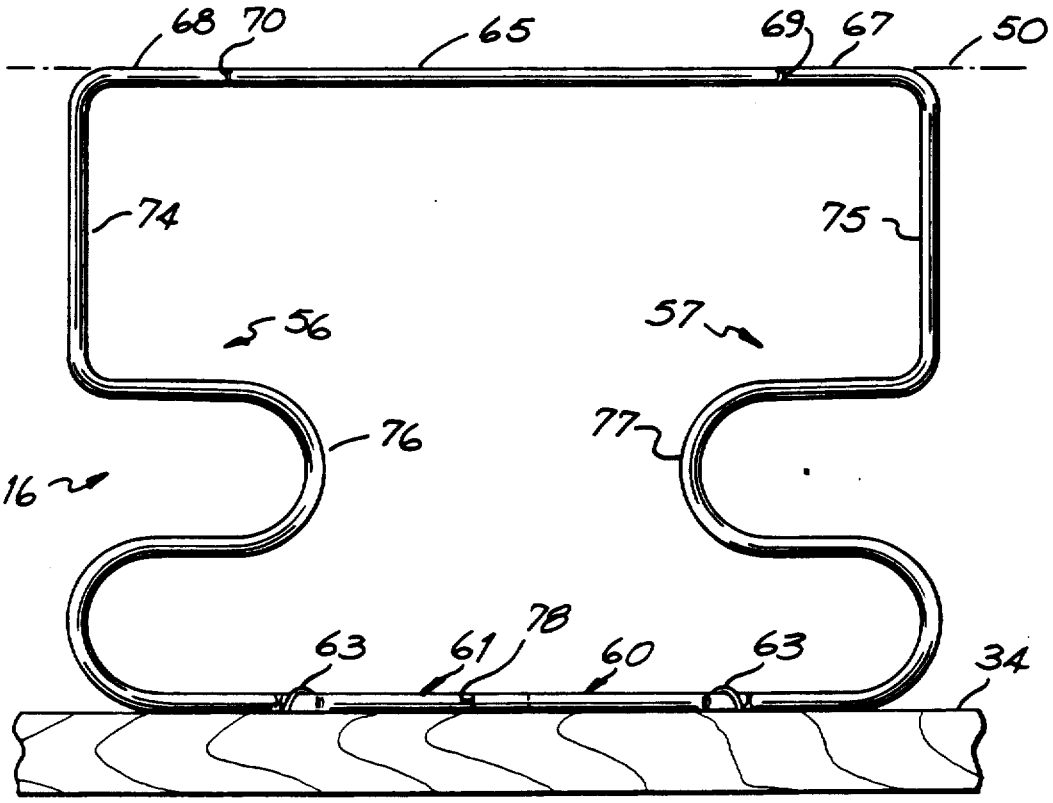
FIG. 4 is a frontal view of the modular spring of FIG. 3.
Figure 5:
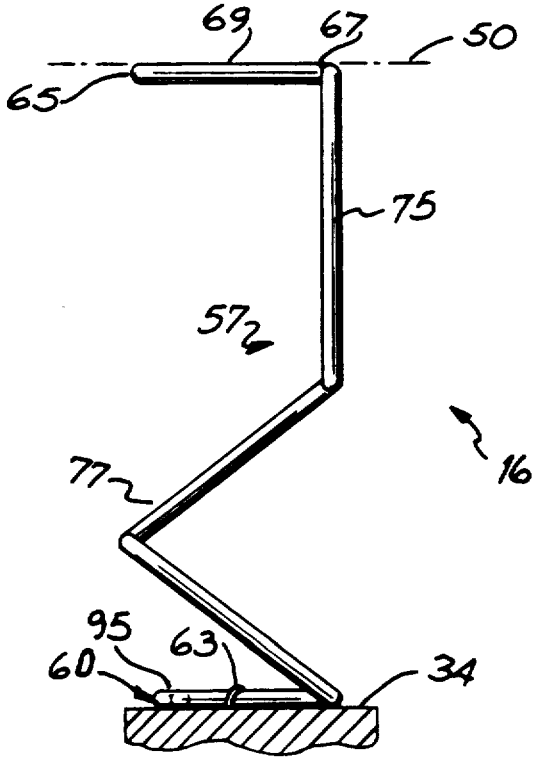
FIG. 5 is a side view of the modular spring of FIG. 3.

Referring now to FIGS. 3-5, the planar top section 50 of each modular spring 16 comprises five segments: a centermost longitudinal section 65; two coplanar longitudinal end sections 67 and 68, parallel to and coplanar with centermost longitudinal section 65; and two transverse straight portions 69 and 70, coplanar with and connected between centermost longitudinal section 65 and longitudinal end sections 67 and 68. This planar top section 50 of each modular spring 16 may best be thought of as four bends in a single wire forming the five coplanar segments 65, 67, 68, 69 and 70. The vertical legs 56 and 57 of modular spring 16 each have, respectively, a vertical straight upper portion 74 and 75, each depending from a longitudinal end section; and an S-shaped lower portion 76 and 77, each depending from the corresponding vertical straight upper portion 74 and 75. Each of the foot sections 61 and 60 extend laterally out from an S-shaped lower portion 76 and 77, respectively, and may have a generally L-shape and lie in a plane generally parallel to the plane of frame 12. Each foot section 60 and 61 has a free end 78 and 79, respectively.

The planar top section 50 of each modular spring 16 connects to the grid wires 40 and 42 of coplanar top portion 14 as shown in FIG. 3. One grid wire 80 of the second plurality of spaced parallel grid wires 42 extends over transverse straight portions 69 and 70 at 82 and 83, respectively. A second grid wire 84 of the second plurality of spaced parallel grid wires 42 extends under transverse straight portions 69 and 70 at 86 and 87, respectively. Finally, wires 90 and 91 of the first plurality of spaced parallel grid wires 40 extend over longitudinal end sections 67 and 68, respectively, at 92 and 93. Thus, each snap-fit section of each modular spring 16 is held in place by four grid wires 80, 84, 90, and 91.

Preferably, each pair of grid wires 80 and 84 of the second plurality of spaced parallel grid wires 42 are crimped or detented where they cross the planar top sections of each modular spring 16 at 82, 83, 86, and 87. Each grid wire 80 is crimped upward at each cross point. Each grid wire 84 is crimped downward at each cross point. These crimps allow the planar top portion 14 to lie in substantially a plane defined by the planar top sections 50 of modular springs 16 and retain the planar top sections of the modules against lateral movement relative to the grid.

Preferably, the free end 78 of foot section 60 and the free end 79 of foot section 61 are welded or otherwise connected together, for example, at 95. Having foot sections 60 and 61 connected together imparts additional stability to the modular spring 16, such that only two staples 63, one on each foot section, is required to adequately secure the modular spring 16 to frame 12.

The lower portion of each vertical leg 56 and 57 is arcuately shaped, and preferably S-shaped, so that vertical legs 56 and 57 perform more like coils and are therefore more resilient than vertical legs shaped from generally 90° bends, such as those disclosed in U.S. Pat. No. 4,000,531.

The second plurality of spaced parallel grid wires 42 are not spaced evenly apart, since grid wires 80 and 84 must be close enough to lock with the snap-fit sections of each modular spring 16. Grid wires from the first plurality of spaced parallel grid wires 40 may or may not be spaced evenly apart.

Figure 6:
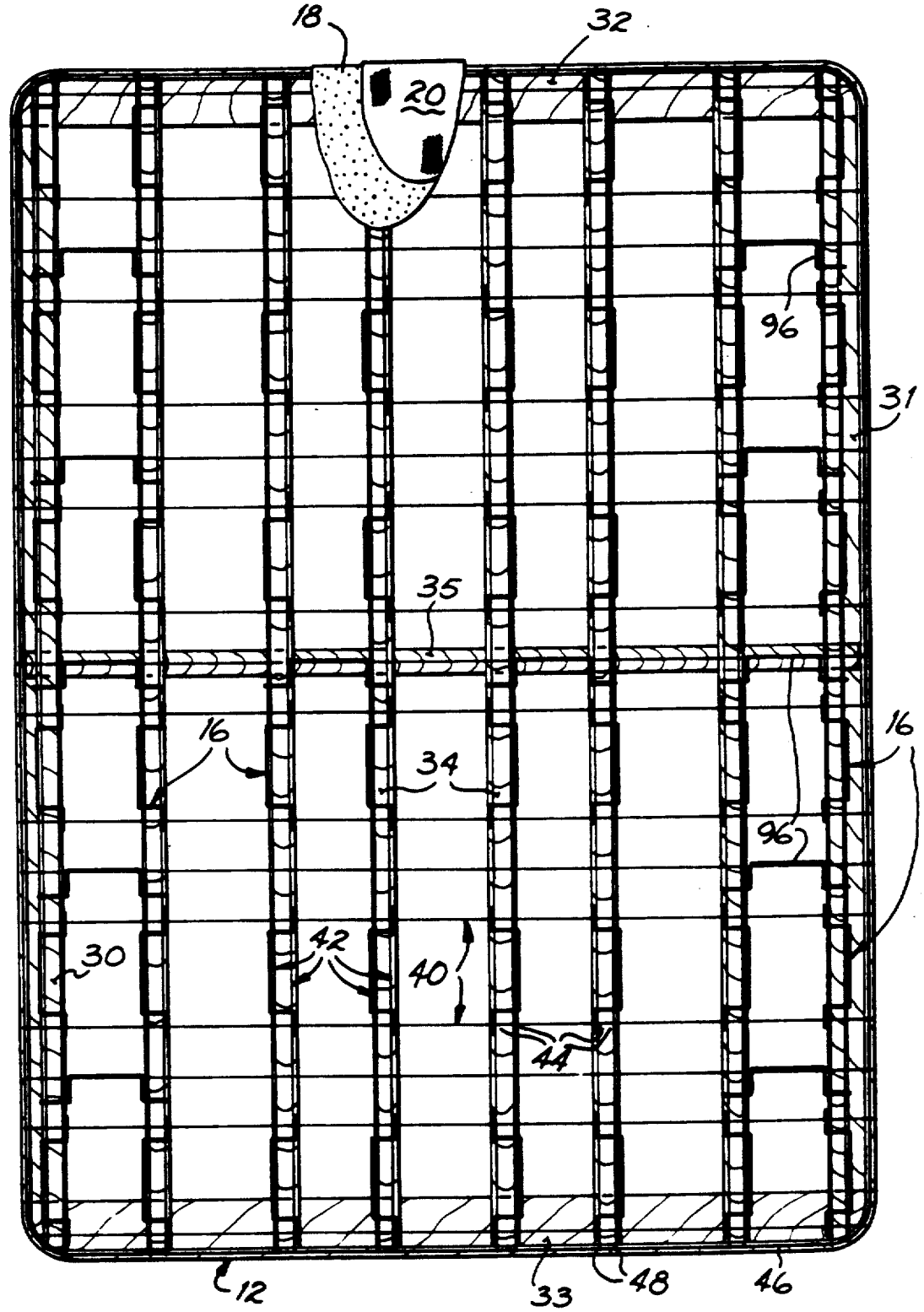
FIG. 6 is a top plan view, mostly broken away, of an alternative foundation unit incorporating the present invention.

In an alternative embodiment 10', as shown in FIG. 6, one type of modular spring is used in a two spring attachment configuration in the foundation unit. The principal difference between this embodiment and the previously described embodiment of FIGS. 1-5 is that most of the modular springs are positioned to extend longitudinally but a few are positioned to extend laterally of the unit. The longitudinally extending modular springs 16 are positioned with the same longitudinal spring attachment configuration as described in the previous embodiment. The laterally or transversely extending modular springs 96 are positioned laterally (i.e., generally perpendicular to modular springs 16) but are identical in structure to modular springs 16, comprising the same planar top section 50, two vertical legs 56 and 57, and two foot sections 61 and 60. The foot sections 60 and 61 of lateral modular springs 96 are attached to frame 12 such that the planar top section 50 straddles at least two spaced apart longitudinal slats 34, with some of the lateral modular springs 96 being interspaced along the length of cross-slat 35. In addition, the planar top sections 50 of lateral modular springs 96 are connected to grid wires 40 and/or 42 of planar top portion 14 by metal clips (not shown) or other similar connection means.

While we have described only two embodiments of our invention, persons skilled in the art to which it applies will readily appreciate numerous changes and modifications which may be made without departing from the spirit of my invention. Therefore, we do not intend to be limited except by the scope of the following claims.

We claim:

1. A bedding foundation unit comprising:

(a) a frame;

(b) a planar top portion spaced above said frame, and comprising a first plurality of spaced parallel grid wires and a second plurality of spaced parallel grid wires lying perpendicular to and connected to said first plurality of spaced parallel grid wires;

(c) a plurality of modular springs extending between said planar top portion and said frame, each said modular spring comprising a planar top section, two vertical legs, and two foot sections, each of said vertical legs comprising a vertical straight portion and at least one arcuate portion having an arc of at least about 180 , said planar top section comprising a centermost longitudinal section and two longitudinal end sections, each said longitudinal end section being generally parallel to and offset from said centermost longitudinal section and being connected thereto by a transverse straight portion, each said longitudinal end section being connected to one of said vertical legs, each of said vertical legs being connected to said frame by one of said foot sections, and each of said vertical legs being located beneath said planar top section; and (d) snap-fit means securing each said modular spring to said planar top portion, said snap-fit means comprising a first parallel grid wire from said second plurality of spaced parallel grid wires extending over both transverse straight portions of said modular spring, a second parallel grid wire from said second plurality of spaced parallel grid wires extending under both transverse straight portions of said modular spring, and a pair of parallel grid wires from said first plurality of spaced parallel grid wires, wherein one of said pair of parallel grid wires extends over one of said longitudinal end sections of said modular spring and another of said pair of parallel grid wires extends over another of said longitudinal end sections of said modular spring.

2. The foundation unit of claim 1 wherein each of said vertical straight portions is connected to one of said longitudinal end sections and each of said arcuate portions is connected to one of said foot sections.

3. The foundation unit of claim 1 wherein each of said vertical legs has two arcuate portions, with each arcuate portion having an arc of at least about 180°.

4. The foundation unit of claim 3 wherein the two arcuate portions of each of said vertical legs generally form an S.

5. The foundation unit of claim 1 wherein said foot sections are generally coplanar and lie generally parallel to the plane of said frame.

6. A foundation unit comprising:

(a) a frame;

(b) a planar top portion spaced above said frame, and comprising a first plurality of spaced parallel grid wires and a second plurality of spaced parallel grid wires lying perpendicular to and connected to said first plurality of spaced parallel grid wires;

(c) a plurality of modular springs extending between said planar top portion and said frame, each said modular spring comprising a planar top section, two vertical legs, and two foot sections, each of said vertical legs comprising a vertical straight upper portion and a generally S-shaped lower portion, said planar top section comprising a centermost longitudinal section and two longitudinal end sections, each said longitudinal end section being generally parallel to and offset from said centermost longitudinal section and being connected thereto by a transverse straight portion, each said longitudinal end section being connected to one of said vertical straight upper portions of one of said vertical legs, each of said S-shaped lower portions being connected to said frame by one of said foot sections, and each of said vertical legs being located beneath said planar top section; and (d) snap-fit means securing each said modular spring to said planar top portion, said snap-fit means comprising a first parallel grid wire from said second plurality of spaced parallel grid wires extending over both transverse straight portions of said modular spring, a second parallel grid wire from said second plurality of spaced parallel grid wires extending under both transverse straight portions of said modular spring, and a pair of parallel grid wires from said first plurality of spaced parallel grid wires, wherein one of said pair of parallel grid wires extends over one of said longitudinal end sections of said modular spring and another of said pair of parallel grid wires extends over another of said longitudinal end sections of said modular spring.

7. The foundation unit of claim 6 wherein said first plurality of spaced parallel grid wires are connected to said second plurality of spaced parallel grid wires by welding.

8. The foundation unit of claim 6 wherein each said parallel grid wire from said second plurality of spaced parallel grid wires is crimped at each point where said parallel grid wire crosses said transverse straight portion of said longitudinal modular spring, such that said planar top portion lies substantially in a plane defined by said planar top sections of said modular springs.

9. The foundation unit of claim 6 wherein said foot sections are generally coplanar and lie generally parallel to the plane of said frame.

10. The foundation unit of claim 9 wherein each said foot section is generally L-shaped and has a free end, with the free ends of each modular spring being connected together.

11. The foundation unit of claim 10 wherein the free ends of each modular spring are welded together.

12. A box spring unit comprising:

(a) a rectangular frame;

(b) a planar top portion spaced above said frame, and comprising a first plurality of spaced parallel grid wires and a second plurality of spaced parallel grid wires lying perpendicular to and connected to said first plurality of spaced parallel grid wires;

(c) a first plurality of modular springs extending between said planar top portion and said frame, each said modular spring comprising a planar top section, two vertical legs, and two foot sections, each of said vertical legs comprising a vertical straight upper portion and a generally S-shaped lower portion, said planar top section comprising a centermost longitudinal section and two longitudinal end sections, each said longitudinal end section being generally parallel to and offset from said centermost longitudinal section and being connected thereto by a transverse straight portion, each said longitudinal end section being connected to one of said vertical straight upper portions of one of said vertical legs, each of said S-shaped lower portions being connected to said frame by one of said foot sections, and each of said vertical legs being located beneath said planar top section;

(d) snap-fit means securing each of said first plurality of modular springs to said planar top portion, said snap-fit means comprising a first parallel grid wire from said second plurality of spaced parallel grid wires extending over both transverse straight portions of each of said first plurality of modular springs, a second parallel grid wire from said second plurality of spaced parallel grid wires extending under both transverse straight portions of each of said first plurality of modular springs, and a pair of parallel grid wires from said first plurality of spaced parallel grid wires, wherein one of said pair of parallel grid wires extends over one of said longitudinal end sections of each of said first plurality of modular springs and another of said pair of parallel grid wires extends over another of said longitudinal end sections of each of said first (e) a pad overlying said planar top portion; and (f) a fabric cover covering said pad, said planar top portion and all said modular springs.

13. The box spring unit of claim 12 wherein said first plurality of spaced parallel grid wires are connected to said second plurality of spaced parallel grid wires by welding.

14. The box spring unit of claim 12 wherein each said parallel grid wire from said second plurality of spaced parallel grid wires is crimped at each point where said parallel grid wire crosses said transverse straight portion of each of said first plurality of modular springs, such that said planar top portion lies substantially in a plane defined by said planar top sections of said first plurality of modular springs.

15. The box spring unit of claim 12 wherein said foot sections are generally coplanar and lie generally parallel to the plane of said frame.

16. The box spring unit of claim 15 wherein each said foot section is generally L-shaped and has a free end, and the free ends of each modular spring are connected together.

17. The box spring unit of claim 16 wherein the free ends of each modular spring are welded together.

18. The box spring unit of claim 12 wherein said frame comprises two laterally spaced longitudinal frame members, two longitudinally spaced lateral frame members and a plurality of spaced apart longitudinal slats, and wherein said first plurality of modular springs are connected to and interspaced along the length of said longitudinal frame members and said longitudinal slats.

19. The box spring unit of claim 18 wherein each half of said box spring unit is generally a mirror image of the other half of said box spring unit.

20. The box spring unit of claim 18 wherein said longitudinal slats are located between said longitudinal frame members.

21. The box spring unit of claim 18 further comprising:

a second plurality of modular springs extending between said planar top portion and said frame and having vertical legs which are connected to said frame such that the centermost longitudinal section of each of said second plurality of modular springs is generally parallel to said lateral frame members.

22. The box spring unit of claim 21 wherein each half of said box spring unit is generally a mirror image of the other half of said box spring unit.

23. The box spring unit of claim 21 wherein each of said second plurality of modular springs is secured to said planar top portion with at least one clip.

24. The box spring unit of claim 23 wherein the centermost longitudinal section of each of said second plurality of modular springs is connected to at least one parallel grid wire from said first plurality of spaced parallel grid wires.

25. A modular spring, for use in a bedding foundation unit, comprising:

(a) a planar top section comprising a centermost longitudinal section and two longitudinal end sections, each said longitudinal end section being generally parallel to and offset from said centermost longitudinal section and being connected thereto by a transverse straight portion;

(b) two vertical legs, each of said vertical legs comprising a vertical straight portion, at least three horizontal straight torsion portions, and at least two arcuate portions, each arcuate portion having a continuous arc of at least about 180° interconnecting two of said three horizontal straight torsion portions, and each of said longitudinal end sections being connected to one of said vertical legs; and (c) two foot sections, each of said foot sections being connected to one of said vertical legs.

26. The modular spring of claim 25 wherein the two arcuate lower portions and the three horizontal straight torsion portions of each of said vertical legs generally from an S.

27. The modular spring of claim 25 wherein said foot sections are generally coplanar.

28. A snap-fit modular spring, for use in a foundation unit, comprising:

(a) a planar top section comprising a centermost longitudinal section and two longitudinal end sections, each of said longitudinal end sections being generally parallel to and offset from said centermost longitudinal section and being connected thereto by a transverse straight portion;

(b) two vertical legs, each of said vertical legs comprising a vertical straight upper portion and a generally S-shaped lower portion, each of said generally S-shaped lower portions comprising an upper horizontal straight torsion portion, an upper arcuate portion, an intermediate horizontal torsion portion, a lower arcuate portion and a lower horizontal torsion portion, with each of said upper horizontal straight torsion portions being connected to one of said vertical straight upper portions and each of said longitudinal end sections being connected to one of said vertical straight upper portions of one of said vertical legs; and (c) two foot sections, with the lower horizontal straight torsion portion of each of said S-shaped portions being connected to one of said foot sections.

29. The modular spring of claim 28 wherein said foot sections are generally coplanar.

30. The modular spring of claim 29 wherein each said foot section is generally L-shaped and has a free end, with said free ends being connected together.

31. The modular spring of claim 30 wherein said free ends are welded together.

* * * * *

UNITED STATES PATENT AND TRADEMARK OFFICE

CERTIFICATE OF CORRECTION

PATENT NO. : 5,197,155

DATED : March 30, 1993

INVENTOR(S) : Steven E. Ogle and Danny L. Wylie

It is certified that error appears in the above-indentified patent and that said Letters Patent is hereby corrected as shown below:

In column 5, line 44, after "180", insert --°--.

In column 7, line 53, after "first", insert --plurality of modular springs;--.

In column 8, line 64, "from" should be --form--.

Signed and Sealed this

Twenty-second Day of February, 1994

*Attest:*

Bruce Lehman

BRUCE LEHMAN

*Attesting Officer*

*Commissioner of Patents and Trademarks*